US005239946A

United States Patent [19]

Garcia-Mallol

[11] Patent Number: 5,239,946

[45] Date of Patent: Aug. 31, 1993

[54] FLUIDIZED BED REACTOR SYSTEM AND METHOD HAVING A HEAT EXCHANGER

[75] Inventor: Juan A. Garcia-Mallol, Morristown, N.J.

[73] Assignee: Foster Wheeler Energy Corporation, Clinton, N.J.

[21] Appl. No.: 895,051

[22] Filed: Jun. 8, 1992

[51] Int. Cl.[5] ..... F22B 1/00

[52] U.S. Cl. ..... 122/4 D

[58] Field of Search ..... 122/1 R, 4 D; 110/245; 165/104.16; 422/146

[56] References Cited

U.S. PATENT DOCUMENTS 3,893,426 7/1975 Bryers .
4,111,158 9/1978 Reh et al. .
4,165,717 8/1979 Reh et al. .
4,275,668 6/1981 Daman .
4,338,283 7/1982 Sakamoto et al. .
4,469,050 9/1984 Korenberg .
4,548,138 10/1985 Korenberg .
4,594,967 6/1986 Wolowodiuk .
4,617,877 10/1986 Gamble .
4,665,864 5/1987 Seshamani et al. .
4,672,918 6/1987 Engstrom et al. .
4,682,567 7/1987 Garcia-Mallol et al. .
4,686,939 8/1987 Stromberg .
4,694,758 9/1987 Gorzegno et al. .
4,704,084 11/1987 Liu et al. .
4,709,662 12/1987 Rawdon .
4,716,856 1/1988 Beisswenger et al. .
4,761,131 8/1988 Abdulally .
4,809,625 3/1989 Garcia-Mallol et al. .
4,813,479 3/1989 Wahlgren .
4,827,723 5/1989 Engstrom et al. .
4,845,942 7/1989 Schemenam et al. ..... 122/4 D X
4,856,460 8/1989 Wied et al. .
4,860,693 8/1989 Jarvstrat .
4,896,717 1/1990 Campbell, Jr. et al. .
4,915,061 4/1990 Garcia-Mallol .
4,947,804 8/1990 Abdulally .
4,962,711 10/1990 Yamauchi et al. .
4,969,930 11/1990 Arpalahti .
5,054,436 10/1991 Dietz .
5,108,712 4/1992 Alliston et al. .
5,181,481 1/1993 Dietz ..... 122/4 D

*Primary Examiner*—Edward G. Favors
*Attorney, Agent, or Firm*—Marvin A. Naigur

[57] ABSTRACT

A fluidized bed reactor in which a heat exchanger is located adjacent the reactor with each enclosing a fluidized bed and sharing a common wall including a plurality of water tubes. A mixture of flue gases and entrained particulate materials from the fluidized bed in the reactor are separated and the separated particulate material is passed to the fluidized bed in the heat exchanger. Coolant is passed in a heat exchange relation with the separated materials in the heat exchanger to remove heat from the materials after which they are passed to the fluidized bed in the reactor. Auxiliary fuel is supplied to the heat exchanger for combustion to control the temperature of the coolant. When the system of the present invention is utilized to generate steam the coolant can be controlled to match the requirements of a steam turbine.

20 Claims, 1 Drawing Sheet

FLUIDIZED BED REACTOR SYSTEM AND METHOD HAVING A HEAT EXCHANGER

BACKGROUND OF THE INVENTION

This invention relates to fluidized bed reactors, and more particularly, to a system and method in which a heat exchanger is provided adjacent a fluidized bed reactor.

Fluidized bed reactors generally involve passing air through a bed of particulate material, including a fossil fuel, such as sulfur containing coal, and an adsorbent for the sulfur-oxides generated as a result of combustion of the coal, to fluidize the bed and to promote the combustion of the fuel at a relatively low temperature. When the reactor is utilized in a steam generation system to drive a steam turbine, or the like, water or coolant is passed through conventional water flow circuitry in a heat exchange relation to the fluidized bed material to generate steam. The system includes a separator which separates the entrained particulate solids from the flue gases from the fluidized bed reactor and recycles them into the bed. This results in an attractive combination of high combustion efficiency, high sulfur oxides adsorption, low nitrogen oxides emissions and fuel flexibility.

The most typical fluidized bed utilized in the reactor of these type systems is commonly referred to as a "bubbling" fluidized bed in which the bed of particulate material has a relatively high density and a well defined, or discrete, upper surface. Other types of fluidized beds utilize a "circulating" fluidized bed. According to this technique, the fluidized bed density may be below that of a typical bubbling fluidized bed, the air velocity is equal to or greater than that of a bubbling bed, and the flue gases passing through the bed entrain a substantial amount of the fine particulate solids to the extent that they are substantially saturated therewith.

Also, circulating fluidized beds are characterized by relatively high solids recycling which makes the bed insensitive to fuel heat release patterns, thus minimizing temperature variations, and therefore, stabilizing the nitrogen oxides emissions at a low level. The high solids recycling improves the overall system efficiency owing to the increase in sulfur-oxides adsorbent and fuel residence times which reduces the adsorbent and fuel consumption.

Often in circulating fluidized bed reactors, a heat exchanger is located in the return solids-stream from the cyclone separator which utilizes water cooled surfaces for the extraction of thermal energy at a high heat transfer rate. In steam generation applications this additional thermal energy can be utilized to regulate the exit temperature of the steam to better match the turbine requirements. Typically, at relatively high demand loads, the heat exchanger supplies only a relatively small percentage of the total thermal load to the reactor, while at relatively low demand loads, the heat exchanger could supply up to approximately 20% of the total thermal load.

Unfortunately, while the heat exchanger could thus supply a significant percentage of the total thermal load of a fluidized bed reactor under low demand loads and start-up conditions, the heat exchanger typically has limited capacity for thermal regulation. More particularly, during these low demand loads and start-up conditions, the exit temperature of the water/steam is less than optimum due to the reactor conditions taking precedence. This results in a decrease in the overall efficiency of the system and in an increase in mechanical stress on the external equipment that receives the mismatched coolant.

SUMMARY OF THE INVENTION

It is therefore an object of the present invention to provide a fluidized bed reactor system and method in which a heat exchanger is provided adjacent the reactor section which provides additional capacity for thermal regulation.

It is a further object of the present invention to provide a system and method of the above type in which the superficial fluidizing velocity of the fluidized bed in the heat exchanger is varied according to the reactor's thermal demand requirement.

It is a further object of the present invention to provide a system and method of the above type in which the size of the fluidized bed in the heat exchanger is varied according to the reactor's thermal demand requirement.

It is a further object of the present invention to provide a system and method of the above type in which external fuel is supplied to the heat exchanger according to the reactor's thermal demand requirement.

Toward the fulfillment of these and other objects, the system of the present invention includes a heat exchanger containing a fluidizing bed and located adjacent the reactor section of the system. The flue gases and entrained particulate materials from the fluidized bed in the reactor are separated, the flue gases are passed to the heat recovery area and the separated particulate materials are passed to the heat exchanger. The particulate materials from the reactor are fluidized and heat exchange surfaces are provided in the heat exchanger for extracting heat from the fluidized particles. Further, burners are disposed within the heat exchanger for supplying additional heat energy in the event of low demand loads and start up conditions. The solids in the heat exchanger are returned to the fluidized bed in the reactor.

BRIEF DESCRIPTION OF THE DRAWINGS

The above description, as well as further objects, features and advantages of the present invention will be more fully appreciated by reference to the following detailed description of the presently preferred but nonetheless illustrative embodiments in accordance with the present invention when taken in conjunction with the accompanying drawing wherein.

DESCRIPTION OF THE PREFERRED EMBODIMENT

Figure 1:
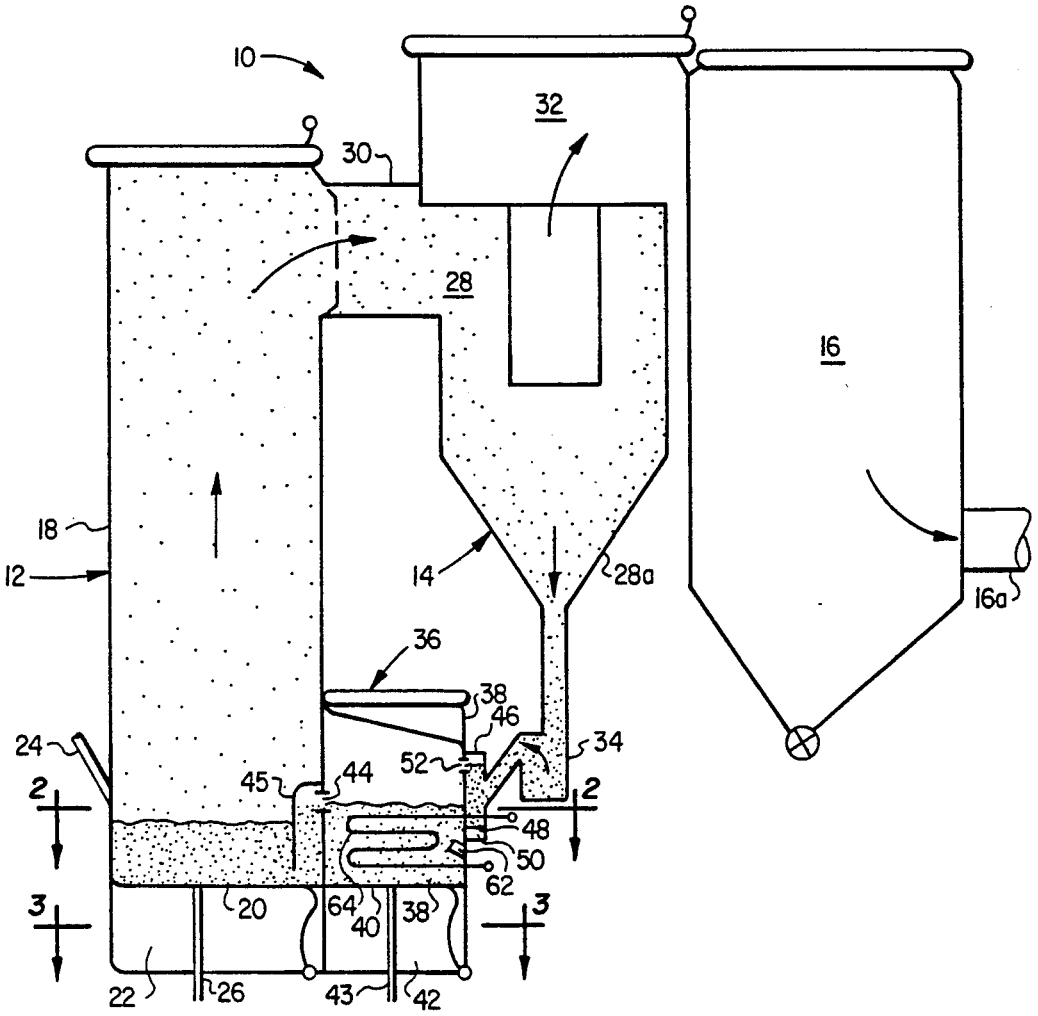
FIG. 1 is a schematic view depicting a fluidized bed reactor of the present invention.

The system and method of the present invention will be described in connection with a fluidized bed reactor forming a portion of a natural water circulating steam generator shown in general by the reference numeral 10 in FIG. 1 of the drawings.

The steam generator 10 includes a fluidized bed reactor 12, a separating section 14, and a heat recovery area 16. The reactor 12 includes an upright enclosure 18 and a perforated air distributor plate 20 disposed in the lower portion of the reactor and suitably attached to the walls of the enclosure for supporting a bed of particulate material including coal and relatively fine particles of sorbent material, such as limestone, for absorbing the sulfur oxides generated during the combustion of the coal. A plenum 22 is defined below the plate 20 for receiving air which is supplied from a suitable source (not shown), such as a forced draft blower, and appropriately regulated to fluidize the bed of particulate material, and according to a preferred embodiment, the velocity of the air is of a magnitude to create a circulating fluidized bed as described above. One or more distributors 24 are provided through the walls of the enclosure 18 for introducing the particulate material onto the bed and a drain pipe 26 registers with an opening in the distributor plate 20 for discharging relatively-coarse spent particulate material from the enclosure 18.

It is understood that the walls of the enclosure 18 include a plurality of water tubes disposed in a vertically extending relationship and that flow circuitry (not shown) is provided to pass water through the tubes to convert the water to steam. Since the construction of the walls of the enclosure 18 is conventional, the walls will not be described in any further detail.

The separating section 14 includes one or more cyclone separators 28 provided adjacent the enclosure 18 and connected thereto by a duct 30 which extends from an opening formed in the upper portion of the rear wall of the enclosure 18 to an inlet opening formed in the upper portion of the separator 28. The separator 28 receives the flue gases and entrained relatively fine particulate material from the fluidized bed in the enclosure 18 and operates in a conventional manner to separate the relatively fine particulate material from the flue gases by the centrifugal forces created in the separator. The relatively-clean flue gases rise in the separator 28 and pass into and through the heat recovery area 16 via a duct 32. The heat recovery area 16 operates to extract heat from the clean flue gases in a conventional manner after which the gases are discharged, via outlet duct 16*a*.

The separated solids from the separator 28 pass into a hopper 28*a* connected to the lower end of the separator and then into a dipleg 34 connected to the outlet of the hopper. The dipleg 34 is connected to a heat exchanger 36 which includes a substantially rectangular enclosure 38 disposed adjacent to, and sharing the lower portion of the rear wall of, the enclosure 18. An air distributor plate 40 is disposed at the lower portion of the enclosure 38 and defines an air plenum 42 to introduce air received from an external source (not shown) through the distribution plate 40 and into the interior of the enclosure 38. Three drain pipes, one of which is shown by reference numeral 43 in FIG. 1, register with openings in the plate 40 for discharging relatively fine spent particulate material from the interior of the enclosure 38, as will be discussed. Three openings, one of which is shown by reference numeral 44 in FIG. 1, are formed through the common wall between the enclosures 38 and 18 for communicating solids and gases from the heat exchanger 36 to the reactor 12, as will be discussed. A partition wall 45 is formed over the opening 44 and extends downwardly to define a passage to allow solid material from the heat exchanger 36 to pass into the interior of the reactor 12.

A small trough enclosure 46 is formed adjacent to, and shares, the middle portion of the rear wall of the enclosure 38 for receiving relatively fine particulate material received from the dipleg 34 and distributing the particulate material to the enclosure 38. An air distributor plate 48 is disposed in the lower portion of the enclosure 46 and defines an air plenum 50 to introduce air received from an external source through the distributor plate 48 and into the interior of the enclosure 46. An opening 52 is formed in the common wall between the enclosure 46 and the enclosure 38 for communicating the solids and the fluidizing air from the enclosure 46 to the enclosure 38.

Figure 2:
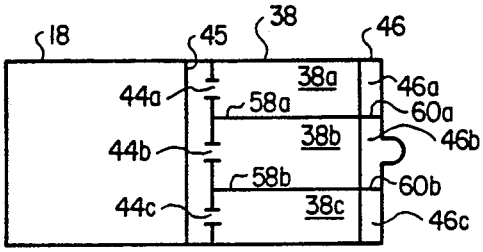
FIG. 2 is a cross sectional view taken along line 2—2 in FIG. 1.
Figure 3:
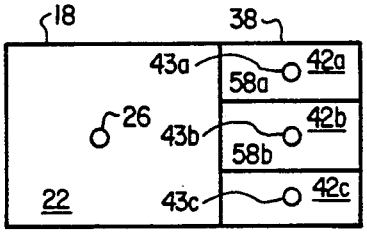
FIG. 3 is a cross sectional view taken along line 3—3 in FIG. 1.

As shown in FIGS. 2 and 3, two partition walls 58*a* and 58*b* are contained in the enclosure 38 and extend from the base of the enclosure, through the plate 40 to the roof the enclosure to divide the plenum 42 and the enclosure 38 into three portions 42*a*, 42*b*, 42*c* and 38*a*, 38*b* and 38*c*, respectively. As shown in FIG. 2, two partition walls 60*a* and 60*b* extend from the base of the enclosure 46, through the plate 48 (FIG. 1) and midway up the walls of the enclosure to divide the enclosure 46 into three portions 46*a*, 46*b*, 46*c*. It is understood that the two partition walls 60*a* and 60*b* also divide the plenum 50 (FIG. 1) into three portions.

Referring to FIG. 1, it is understood that three burners, one of which is shown by the reference numeral 62, are disposed in the enclosure portions 38*a*, 38*b*, 38*c*, respectively, to combust fuel, such as gas or oil, in an ordinary fashion to supply additional heat. Further, three heat exchanger tube bundles, one of which is shown by reference numeral 64, are disposed in the enclosure portions 38*a*, 38*b*, 38*c*, respectively, to receive cooling fluid, such as water, for extracting heat from the relatively fine particulate material in the enclosure portions In addition, three openings 44*a*, 44*b*, 44*c* (FIG. 2) are formed in the common wall between the enclosures 38 and 18, and three drain pipes 43*a*, 43*b*, 43*c* (FIG. 3) register with openings formed in the distributor plate 40 for the discharge of the particulate material from the interior of the enclosure portions 38*a*, 38*b*, 38*c*, respectively, as will be described.

In operation, particulate fuel and adsorbent material from the distributor 24 are introduced into the enclosure 18, as needed. Pressurized air from an external source passes into the air plenum 22, through the distributor plate 20 and into the bed of particulate material in the enclosure 18 to fluidize the material.

A lightoff burner (not shown), or the like, is disposed in the enclosure 18 and is fired to ignite the particulate fuel material. When the temperature of the material reaches a relatively high level, additional fuel from the distributor 24 is discharged into the reactor 12.

The material in the reactor 12 is self-combusted by the heat generated by the combusting fuel material and the mixture of air and gaseous products of combustion (hereinafter referred to as "flue gases") passes upwardly through the reactor 12 and entrain relatively fine particulate material from the bed in the enclosure 18. The velocity of the air introduced, via the air plenum 22, through the distributor plate 20 and into the interior of the reactor 12 is established in accordance with the size of the particulate material in the reactor 12 so that a circulating fluidized bed is formed, that is the particulate material is fluidized to an extent that substantial entrainment of the particulate material in the bed is achieved. Thus the flue gases passing into the upper portion of the reactor 12 are substantially saturated with the relatively fine particulate material. The balance of the air required for complete combustion is introduced as secondary air, in a conventional manner. The saturated flue gases pass to the upper portion of the reactor 12, exit through the duct 30 and pass into the cyclone separator 28. In the separator 28, the relatively fine particulate material is separated from the flue gases and the former passes through the hoppers 28*a* and is injected, via the dipleg 34, into the enclosure portion 46*a*. The cleaned flue gases from the separator 28 exit, via the duct 32, to the heat recovery area 16 for passage through the recovery area 16 before exiting to external equipment. Cooling fluid, such as water, is passed through conventional water flow circuitry, including a superheater, a reheater and an economizer (not shown), disposed in the heat recovery area 16 to extract heat from the flue gases.

The enclosure portion 46*b* receives the relatively fine particulate material from the dipleg 34. The particulate material is fluidized by air supplied to the portion of the plenum 50 disposed below the enclosure portion 46*b*, overflows the enclosure portion 46*b* and fills the enclosure portions 46*a*, 46*c* and the enclosure portion 38*b*. It is understood that the flow of relatively fine particulate material from the enclosure portion 46*b* to the enclosure portions 46*a*, 46*b* and to the enclosure portion 38*b* is regulated by the fluidization velocity of the air supplied to the portion of the plenum 50 disposed below the enclosure portion 46*b*. Similarly, the flow of relatively fine particulate material from the enclosure portions 46*a*, 46*c* to the enclosure portions 38*a*, 38*c*, respectively, is regulated by the fluidization velocity of the air supplied to the portion of the plenum 50 disposed below the enclosure portions 46*a*, 46*c*. In general, the air supplied to the portion of the plenums disposed below the enclosure portions 46*a*, 46*b*, 46*c* is regulated so as to enable the build up of relatively fine particulate material in the enclosure portions 46*a*, 46*c*, 46*c* to a level at least sufficient to cover the heat exchanger tubes 64. The relatively fine particulate material is then either returned, via the openings 44*a*, 44*b*, 44*c*, to the reactor 12 or discharged, via the drain pipes 43*a*, 43*b*, 43*c*, from the enclosure portions 38*a*, 38*b*, 38*c*, respectively, which enables the regulation of the inventory of the relatively fine particulate material in the reactor 12. The fluidization o the particulate material in the enclosure portions 38*a*, 38*b*, and 38*c* is independently regulated by the fluidization velocity of the air supplied to the plenums 42*a*, 42*b*, and 42*c* (FIG. 3), respectively.

Cool fluid, such as water, is passed through the tubes forming the walls of the reactor 12, and the heat exchanger tube bundles 64 in the heat exchanger 36 to extract heat from the beds of particulate material in the reactor and the enclosure portions 38*a*, 38*b* and 38*c*, respectively, to provide temperature control of the later beds. Also, the burners 62 (FIG. 1) provide heat to the beds of particulate material in the enclosure portions 38*a*, 38*b* and 38 during start-up and low load operation, as necessary to provide additional temperature control of the beds.

As a result of the foregoing, substantial regulation of the final exit temperature of the cooling fluid passing through the heat exchanger tube bundles 64 can be obtained to better match the turbine requirements. For example, the flow of fine particulate material to the enclosure portions 38*a*, 38*b*, 38*c* and consequentially, coming in contact with the heat exchange tube bundles 64, can be regulated by the fluidization velocity of the air supplied to the plenums 50, thus regulating the transfer of heat to the cooling fluid flowing through the heat exchange tube bundles 64. In addition, the individual beds disposed in the enclosure portions 38*a*, 38*b*, 38*c* can be independently fluidized or drained by the plenums 42*a*, 42*b*, 42*c*, and the drain pipes 43*a*, 43*b*, 43*c*, respectively, thus further regulating the transfer of heat to the cooling fluid flowing through the heat exchange tube bundles 64. Further, the burners 62 provide substantial heat to the cooling fluid flowing through the heat exchange tube bundles 64 during start-up and low load operation, thus resulting in an increase in the overall system efficiency and in a decrease in mechanical stress on the external equipment that receives the coolant.

It is understood that variations may be made in the foregoing without departing from the scope of the invention. For example, at least part of the additional regulated heat provided to the enclosures 38 may be supplied by a burner heating the air directed towards the plenums 42.

Other modifications, changes and substitutions is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed reactor system comprising a reactor, means for supporting a fluidized bed of combustible particulate material in said reactor, heat exchange means disposed adjacent said reactor, separating means for receiving a mixture of flue gases and entrained particulate material from said fluidized bed and separating said particulate material from said flue gases, means for passing said separated particulate material to said heat exchange means, means for passing air through said separated particulate material in said heat exchange means to fluidize said separated material, means disposed in said heat exchange means for passing a coolant in a heat exchange relation to said separated material to transfer heat from said separated material to said coolant, and means for supplying additional heat to said separated material in said heat exchange means to control the temperature of said coolant.

2. The system of claim 1 wherein said additional heat supplying means comprises burner means disposed in said heat exchange means.

3. The system of claim 1 wherein said heat exchange means shares a common wall with said reactor.

4. The system of claim 3 further comprising partition means disposed in said reactor to define, with said common wall, a vertically extending passage, said common wall having an opening extending therethrough and registering with said passage for passing said material from said heat exchange means to said fluidized bed in said reactor.

5. The system of claim 1 wherein said coolant is water and further comprising means for passing water in a heat exchange relationship to said fluidized bed to convert said water to steam.

6. The system of claim 1 further comprising heat recovery means disposed adjacent said reactor, and means for passing said separated flue gases from said reactor to said heat recovery means.

7. The system of claim 1 wherein said heat exchange means comprises a housing, partition means disposed in said housing to divide said fluidized separated material in said heat exchange means into at least two fluidized beds.

8. The system of claim 7 further comprising means for regulating said fluidizing air to said at least two fluidizing beds in said heat exchanger to individually control the fluidization of said latter fluidized beds and the temperature of said coolant.

9. The system of claim 7 further comprising drain means for individually draining said at least two fluidized beds in said heat exchanger for controlling the temperature of said coolant.

10. The system of claim 7 wherein said means for passing said separated particulate material to said heat exchange means comprises an enclosure disposed adjacent said housing and sharing a common wall with said housing and means for passing said separated particulate material from said separating means to said enclosure.

11. The system of claim 10 wherein said passing means further comprises an opening in said latter common wall for passage of said separated material from said enclosure to said heat exchange means.

12. A method of operating a fluidized bed reactor system comprising the steps of supporting a fluidized bed of combustible particulate material in a said reactor, receiving a mixture of flue gases and entrained particulate material from said fluidized bed and separating said particulate material from said flue gases, passing said separated particulate material from said reactor, passing air through said separated particulate material to fluidize said separated material, passing a coolant in a heat exchange relation to said separated material to transfer heat from said separated material to said coolant, and supplying additional heat to said separated material to control the temperature of said coolant.

13. The method of claim 12 wherein said additional heat is supplied to said separated material by one or more burners.

14. The method of claim 12 wherein said coolant is water and further comprising the step of passing water in a heat exchange relationship to said fluidized bed to convert said water to steam.

15. The method of claim 14 wherein said steam is used to drive a steam turbine and wherein said step of supplying controls the temperature of said coolant to match requirements of said turbine.

16. The method of claim 12 further comprising the steps of passing said separated flue gases from said reactor and recovering heat from said separated flue gases.

17. The method of claim 12 further comprising the step of dividing said fluidized separated material into at least two fluidized beds.

18. The method of claim 17 further comprising the step of regulating said fluidizing air to said at least two fluidizing beds to individually control the fluidization of said latter fluidized beds and the temperature of said coolant.

19. The method of claim 17 further comprising the step of individually draining said at least two fluidized beds in said heat exchanger for controlling the temperature of said coolant.

20. The method of claim 18 further comprising the steps of passing said separated particulate material to an enclosure and then to a heat exchanger before said step of passing air through said separated particulate material.

* * * * *